United States Patent [19]

Ambrose

[11] 4,026,485

[45] May 31, 1977

[54] PLANS CARRIER

[76] Inventor: Arnold A. Ambrose, 255-A Alamaha St., Kahului, Hawaii 96732

[22] Filed: July 26, 1976

[21] Appl. No.: 708,697

[52] U.S. Cl. ..... 242/55; 40/82; 242/74

[51] Int. Cl.[2] ..... B65H 75/00

[58] Field of Search ..... 242/55, 74, 67.1 R, 242/1; 40/82, 83

[56] References Cited

UNITED STATES PATENTS

| | | | |
|---|---|---|---|
| 2,715,788 | 8/1955 | Gutshall | 40/83 |
| 2,951,656 | 9/1960 | Wellman | 242/74 X |
| 3,250,256 | 5/1966 | Brueckner | 40/82 |

*Primary Examiner*—Edward J. McCarthy
*Attorney, Agent, or Firm*—William B. Walter

[57] ABSTRACT

A plans carrier is a protective container and display means for plans, fabric samples and the like comprising a long rigid trough like member with a C-shaped cross section with one end of a flexible protective cover sheet attached to the inside surface of one lip for the length of the trough like member. The other end of the flexible protective cover sheet has an integral tie string.

2 Claims, 5 Drawing Figures

PLANS CARRIER

BACKGROUND OF THE INVENTION

Engineers and architects in carrying their drawings to a conference, sales presentation or jobsite have traditionally rolled the drawings, which may be blueprints or even the originals on vellum, into tight rolls and either inserted them into long mailing tubes or covered the rolled drawings with kraft paper for protection. Since mailing tubes are used and re-used, the outside surface is soon dirty and marred. Drawings placed in mailing tubes are often difficult to remove and when removed are often dirtied, torn or wrinkled when laid down on uneven surfaces. Wrapping paper by itself is usually not a sufficient protection for the drawings as the drawings so wrapped can be easily creased and folded.

A variety of clamping bars are used to display and hold rug and fabric samples. Flat cardboard and fabric covers which may be rolled about drawings or clothing samples are described in U.S. Pat. Nos. 1,134,285 to Page and 1,419,053 to Howard.

SUMMARY OF THE INVENTION

It is the primary object of this invention to obtain a protective carrier for plans, drawings, fabric samples and the like into which the drawings etc. may be easily placed and removed.

It is an object of this invention to obtain such a protective carrier which is light in weight, simple in construction, rigid when closed and attractive.

This invention is a plans carrier comprising a round trough having a retainer groove in one lip of the trough and a length of flexible protective sheet material having one edge held in the retainer groove and preferably having a tie string secured to the opposite end for holding the carrier in rolled condition.

BRIEF DESCRIPTION OF THE DRAWINGS

FIGS. 3, 4 and 5 are enlarged views of a trough particularly with only a portion of the protective sheet shown in FIGS. 4 and 5.

DETAILED DESCRITPION OF THE INVENTION

Figure 3:
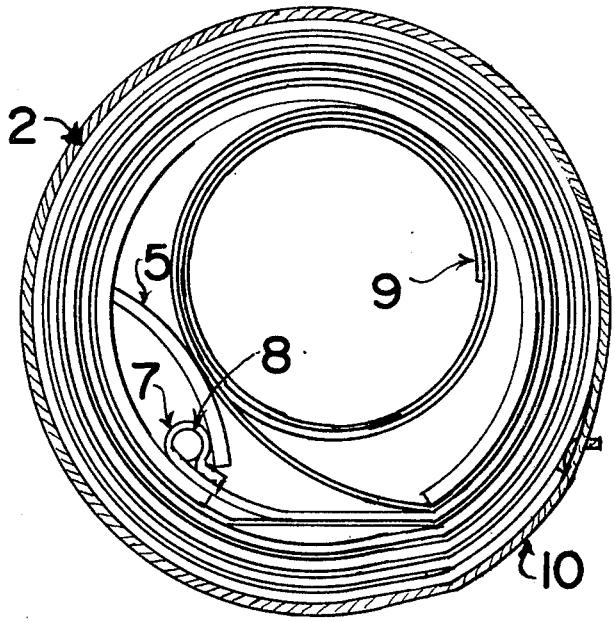
FIG. 3 is an end elevation of the plans carrier holding a drawing, with a portion of the drawing rolled into the trough, and the remainder of the drawing rolled about the trough with the protective sheet and tied for carrying.
Figure 4:
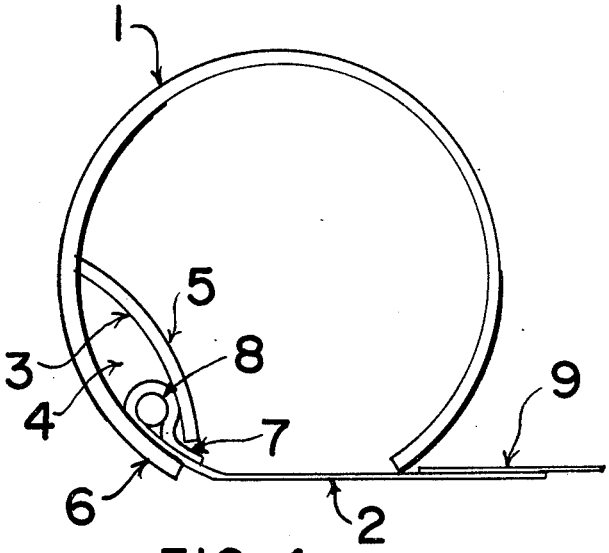
FIG. 4 is an end elevation of the plans carrier when unrolled, and with a drawing laid out on it.
Figure 5:
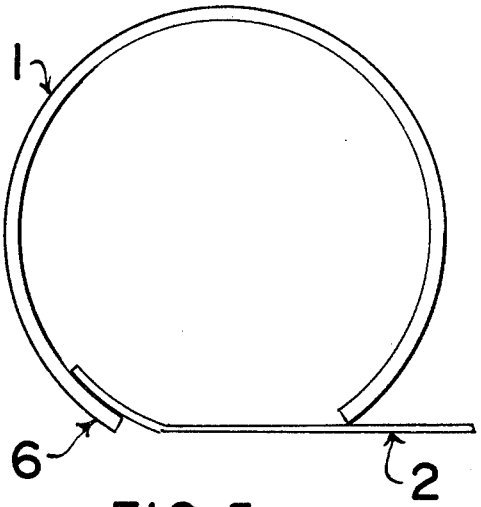
FIG. 5 is an end elevation of the plans carrier in another embodiment wherein the protective sheet is fastened to the inside surface of the trough by glue and other means.

The plans carrier of this invention is comprised of two basic elements as shown best in FIGS. 3, 4 and 5. These elements are the rigid round bottom trough element 1 and the flexible protective cover sheet 2. The trough 1 in the preferred embodiment is simply made from a length of 2 inch class 125 PVC pipe the outside diameter of which is 2172 inches (6cm). A portion or sector 3 of the pipe ¾inches to 1 inch wide (1.9 to 2.5 cm.) is cut for the full length of the pipe and attached to the inside wall of the remainder of the pipe or trough 1 to form a retainer groove 4 in the inside surface of the trough 1 adjacent a lip or longitudinal edge 6. Other methods of forming a retainer groove could be used such as making the trough in that form as an extrusion, however, a groove formed in this manner is not only efficient in the use of materials, but it is strong and provides a smooth slick PVG surface 5 on the inside wall of the trough to ease the insertion of the drawings 9 or fabric samples into the trough for protected storage when carrying them.

The flexible cover sheet 2 which may be vinyl, leather, naugahyde, or any of a multitude of materials is preferably waterproof, light in weight and attractive. With this construction of the retainer groove, the flexible protective cover sheet 2 can be simply retained by forming a beaded edge 7 by doubling over the edge and possibly glueing or sewing the edge down and inserting a cord or rod 8 within the bead to increase its thickness. The plans carrier can thus be made available with a variety of cover sheets 2 according to the desire of the user or changed by the owner to suit his taste and needs.

The width of the cover sheet 2 is equal to the length of the trough 1 and the length is sufficient to display the standard drawings to be carried. Extra long drawings can be accomodated readily by rolling one edge of the drawing 9 into the trough 1 as shown in FIGS. 1 and 3 and the drawing 9 may be pulled out of the trough 1 to the extent desired.

Figure 1:
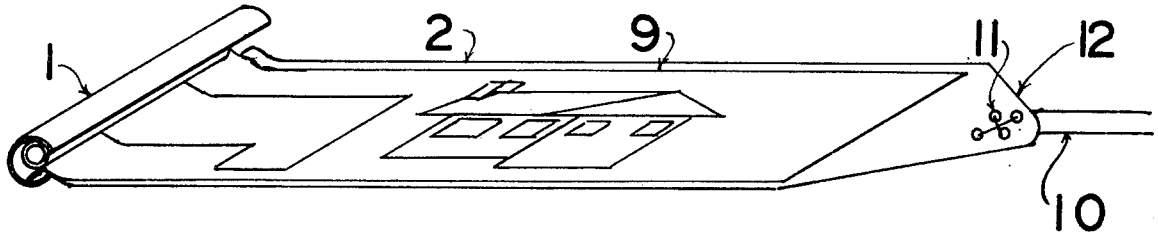
FIG. 1 is a perspective view of the plans carrier when open with a portion of the drawing inserted into the trough and the majorportin of the drawing laid out for display on the the inside surface of the protective sheet.
Figure 2:
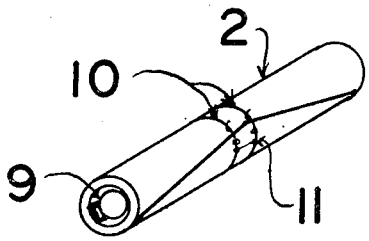
FIG. 2 is a perspective of the plans carrier when closed and holding the drawings.

Although any one of many ways of fastening a tie string 10 to the end of the sheet 2 may be used, the use of 4 eyelets 11 as seen in FIGS. 1 and 2 is very effective and attractive. As seen in FIGS. 1 and 2, the terminal or tie end of the protective sheet is preferably tapered as at 12 so that the corners will be drawn tight. While an integral tie member is not an absolute necessity, its ready availability makes it very desirable. A snap fastener or fasteners or a Velco fastener can be used for the samp purpose.

In an alternate form of construction, the trough 1 can be made as shown in FIG. 5 without a retainer groove 4 for the protective sheet 2 and the latter simply attached to the inside face of one lip or longitudinal edge 6 of the trough 1 by glue or tape having an adhesive on each face. Such tape is termed double faced adhesive tape or double stick tape. One such product which is suitable for this purpose is Arno Carpetack tape.

In use, the plans carrier of this invention is ordinarily prepared for storage by rolling the protective cover 2 tightly about the trough 1 and securing with the tie string 10 as shown in FIG. 2. For use, the tie 10 is released, and the plans carrier is unrolled upon a table or floor. The plans, fabric samples or wall paper samples are then laid out on the inside face of the cover 2 as shown in FIG. 1 with the excess length of drawing merely inserted into the trough 1 where it will naturally form a roll as seen in FIGS. 1 and 3.

To prepare the drawings for carrying in the plans carrier, the trough 1 is then rolled towards the tie string 10 with the drawings 9 protected within the trough 1 and between layers of the protective cover sheet 2, and the tie string 10 used to secure it for carrying as seen in FIG. 2.

A material such as naugahyde which would not normally retain a rolled shape is best suited for use as a protective cover 2 so that when the carrier is opened for displaying the drawings 9, it will remain flat naturally. Display of the plans 9 on the protective cover protects the plans from piercing or creasing on sharp objects which might have been left on the table and from dust and dirt which might also hve been left on the table, floor or ground where the drawings are ordinarily laid out. If the surface upon which the protective cover is laid out is dirty, a simple wiping off the outside surface of the protective cover 2 while rolling the drawings and carrier together will prevent pickup of dirt and contact thereof with the drawings.

I claim:

1. A plans carrier comprising:

a. a long rigid trough member having a C-shaped cross section, and thus two longitudinal edges said trough like member having a length greater than the width of the plan to be carried;

b. a flexible cover sheet having a width approximately equal to the length of the trough member and a length greater than the usual plan to be carried;

c. a first fastening means operably securing one end of the flexible cover to the trough member along the inside surface of the trough along one longitudinal edge of the trough; and d. a second fasteneing means operably securing the free end of the protective cover to the roll when the protective cover has been rolled about the trough member.

2. A plans carrier as claimed in claim 1 wherein the trough member has a retainer groove on the inside surface of one longitudinal edge of the trough for the full length of the trough and wherein one end of the protective cover sheet is provided with a thick edge whereby the first fastening means comprises inserting the thick edge into the retainer groove.

* * * * *